US005937694A

United States Patent [19]

Mueller

[11] Patent Number: 5,937,694

[45] Date of Patent: Aug. 17, 1999

[54] PORTABLE CAM ACTUATED CLINCHING, CRIMPING AND PUNCHING PRESS

[76] Inventor: Tom Mueller, 6501 River Farm Dr., St. Louis, Mo. 63129

[21] Appl. No.: 09/257,791

[22] Filed: Feb. 25, 1999

Related U.S. Application Data

[60] Provisional application No. 60/076,600, Mar. 3, 1998.

[51] Int. Cl.[6] ..... B21J 9/20

[52] U.S. Cl. ..... 72/452.1; 72/452.8; 72/429; 74/110

[58] Field of Search ..... 72/429, 452.4, 72/452.6, 452.7, 452.1, 452.8, 452.9; 74/110, 99 A, 107

[56] References Cited

U.S. PATENT DOCUMENTS

| | | | |
|---|---|---|---|
| 1,094,664 | 4/1914 | Leonardi | 72/452.4 |
| 2,647,814 | 8/1953 | Chilton | 72/452.07 |
| 4,426,869 | 1/1984 | Farmer et al. | 72/452.08 |
| 4,638,731 | 1/1987 | Kato | 72/452.01 |
| 5,309,751 | 5/1994 | Ryan | 72/450 |

*Primary Examiner*—David Jones
*Attorney, Agent, or Firm*—Kevin L. Klug

[57] ABSTRACT

A portable cam actuated press which utilizes the substantial force available from an air spring to move a ram via the camming action of rollers mounted on the air spring, the ram, and on a frame into which all of the components are mounted. The substantial force available from an air spring and the specialty cam system provided allows the device to perform clinching, crimping, punching, stenciling, riveting, stamping or holding operations which would normally be performed with much larger and heavier equipment when the proper punches and dies are installed on the ram and into the frame cutout. The unit operates pneumatically without the need for hydraulics or hydraulically assisted components.

18 Claims, 3 Drawing Sheets

PORTABLE CAM ACTUATED CLINCHING, CRIMPING AND PUNCHING PRESS

This application claims priority of Provisional Patent Application #60/076,600, filed Mar. 3, 1998.

BACKGROUND OF THE INVENTION

The present invention relates in general to punching, crimping and clinching equipment, and more particularly, to a portable punching, crimping and clinching press which is capable of accepting dies and punches capable of clinching or toggle locking sheet metal and which is preferably pneumatically activated. The present invention represents a unique lightweight press system which performs punching, crimping and clinching of sheet metal materials when used with the proper punches and dies.

Clinching is the process of bonding sheet metal materials together with the use of special punches and dies which are manufactured by various manufacturers. The term toggle locking is generically used in the industry and more particularly refers to the use of industry standard Tog-L-Loc ® punches and dies of the BTM Corporation of Marysville, Michigan. During the clinching process, the punches and dies form an indented portion into overlapping sheet metal material which bulges at the base of the indent in order to bond the materials. No claim is made to the actual clinching or toggle locking punches and dies in this application. A typical system of punches and dies which may be used with the present invention may be found in U.S. Pat. No. 4,459,735 assigned to BTM Corporation. The system of the present art is directed to a press system which holds and actuates said clinching punches and dies and may also serve hole punching, crimping, and stenciling functions when used with alternate punch and die sets.

The art of the present invention allows for the use of any combination of punches and dies which provide for various functions such as hole punching, crimping, stenciling, etc. The unique aspects of this device include a lightweight and portable press system which is capable of using compressed air for operation and which provides an air stroke actuator which is capable of flexing in its plain of movement, thereby allowing a topmost cam roller adjustment bolt to control the extension and length of travel of a ram onto which the punch is mounted.

With conventional clinching and punching press systems, ram movement is typically actuated by a hydraulic piston which is either pneumatically pressurized or pressured via a hydraulic pump. This form of actuation typically creates a press which has a bulk and weight which prohibits the press from handheld and portable operation. It further adds to the cost of the press. The few clinching and punching press systems which are strictly pneumatic are of such size and weight that hand held portable operation is not possible. The preferred embodiment of the present art utilizes the substantial force provided by an air stroke actuator in the form of an air spring to actuate a ram which performs clinching, crimping or punching.

Accordingly, it is an object of the present invention to provide an improved clinching, crimping and punching press which provides sufficient force for clinching, crimping and punching and which is also portable and capable of handheld use.

Another object of the present invention is to provide an improved clinching, crimping and punching press which is capable of pneumatic operation with conventional compressed air and without hydraulic cylinders or hydraulic pumping equipment.

A further object of the present invention is to provide an improved clinching, crimping and punching press which is capable of using various punches and dies to perform various operations on sheet metal.

A still further object of the present invention is to provide an improved clinching, crimping and punching press which is manufactured from a minimum number of components and which is cost effective.

SUMMARY OF THE INVENTION

To accomplish the foregoing and other objects of this invention there is provided an improved clinching, crimping and punching press for use in clinching, crimping, punching and stenciling operations and also for holding materials. The system comprises a frame into which is mounted an air stroke actuator, typically an air spring, having a rolling cam attached to a single end, a topmost cam roller, a ram, a ram cam roller, a topmost cam roller adjustment bolt, a stop bolt, return spring and a bearing plate, typically of tool steel, in addition to the special punches and dies. Said frame comprises a preferably metallic frame with a first opening for mounting said air stroke actuator and associated cam components, a cutout for placing or mounting said punch, ram, and die, and a bored hole between said opening and said cutout for placement of said ram. Onto the lowermost end of the ram is mounted a punch. Said ram cam roller is mounted within a ram cam roller housing onto said ram and opposite said punch. Opposite said punch is mounted a die onto the aforementioned frame and within said cutout. Alternative embodiments may place said die onto said ram and said punch opposite said die. Said topmost cam roller is mounted within a topmost cam roller housing and within said first frame opening. Said topmost cam roller housing is moveably attached to said frame opposite said ram cam roller and moveably adjustable with said topmost cam roller adjustment bolt in order to control the travel of said ram.

The bearing plate, typically of tool steel, is mounted onto said frame opposite said rolling cam of said air stroke actuator and functions as a bearing surface for said ram cam roller. A stop bolt is further provided opposite said rolling cam in order to control the limit of movement of the rolling cam. The bearing plate also serves to limit the lateral forces upon the ram, thereby limiting wear within said bored hole and on said ram.

For clinching operations, the punch typically comprises a ram bushing and stripper which are mounted with and onto an end of said punch. The stripper is typically comprised of a flexible yet durable hollow tube which is able to compress during punch use. The ram bushing has a through-hole through which the punch may protrude and is mounted within said stripper. This arrangement allows the sheet metal to be held between the ram and die by said bushing before the punch performs the clinching operation. The punch, stripper, ram bushing, and die components are uniquely adapted to the clinching, punching, crimping or stenciling operation function and are proprietary to the manufacturer of said components. No claim is made to said components apart from their operation and use with the press of the present invention.

In operation, the user installs the desired punch and die combination and places the piece or pieces of sheet metal between said punch and die. Upon application of compressed air to the air stroke actuator, the rolling cam of said air stroke actuator is driven forward between said topmost cam roller and said ram cam roller. Since the topmost cam roller is secured to said frame through said housing, the force placed upon said ram cam roller by the rolling cam causes the ram to be forced downward. The downward movement of the ram causes the aforementioned punch to contact and compress the piece or pieces of sheet metal between said punch and die. The extension of the punch into the die is limited by the control and adjustment of the topmost cam roller adjustment bolt. The ram returns to its rest position when the air pressure to the air stroke actuator is released via the action of the return spring.

This press and its associated components may be manufactured of many types of materials including but not limited to plastic, composites, and various metals and their alloys as required by the application. In a preferred embodiment, the frame and housings are manufactured from an aluminum alloy, and the ram, rollers, bolts and bearing plate from steel where said bearing plate is a tool steel.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
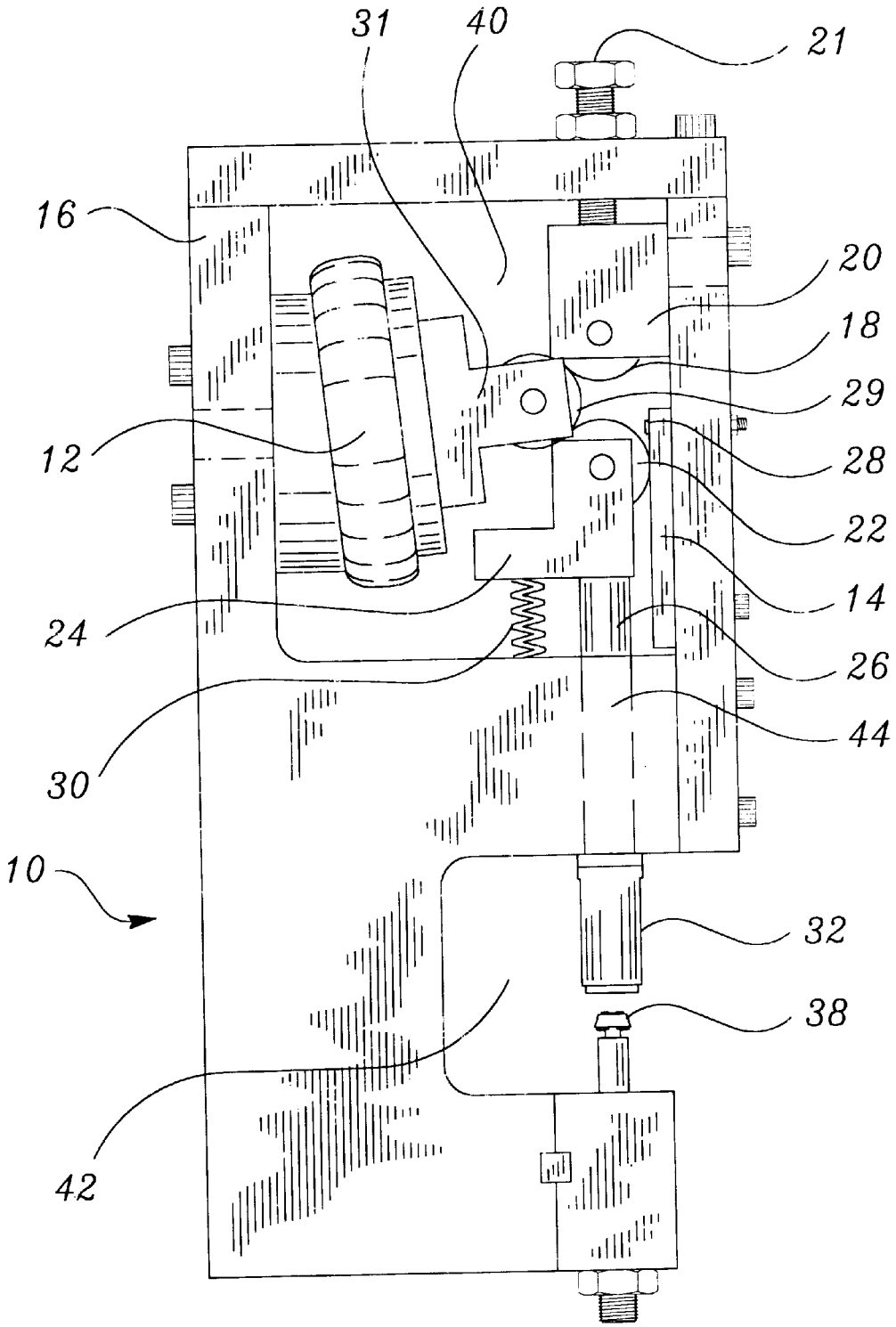
FIG. 1 is a right side plan view of an improved clinching, crimping and punching press with the ram in an open position and the air stroke actuator un-pressurized. The right side plan view is symmetric with the left side plan view.
Figure 2:
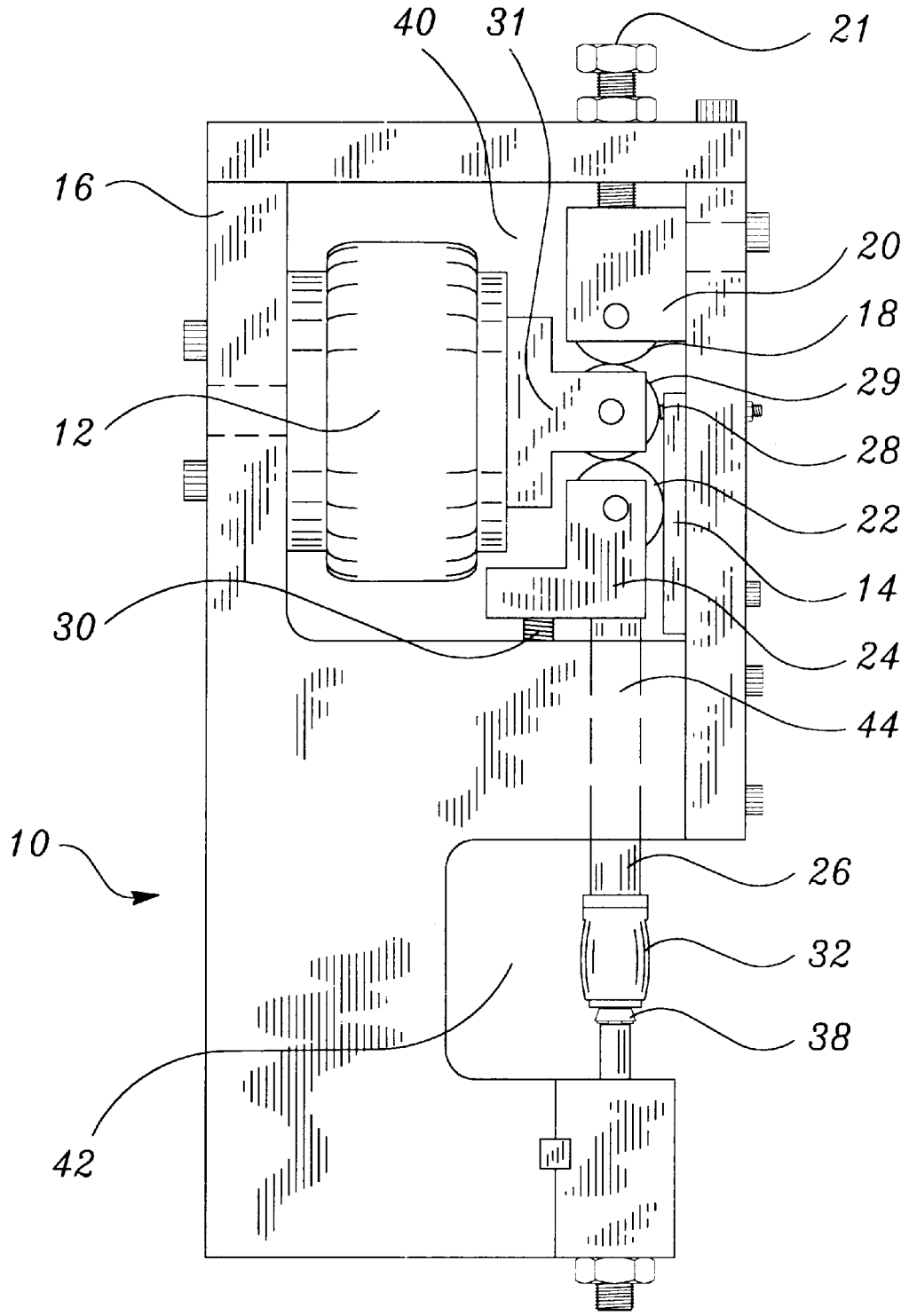
FIG. 2 is a right side plan view of an improved clinching, crimping and punching press with the ram in a closed position and the air stroke actuator pressurized. The right side plan view is symmetric with the left side plan view.
Figure 3:
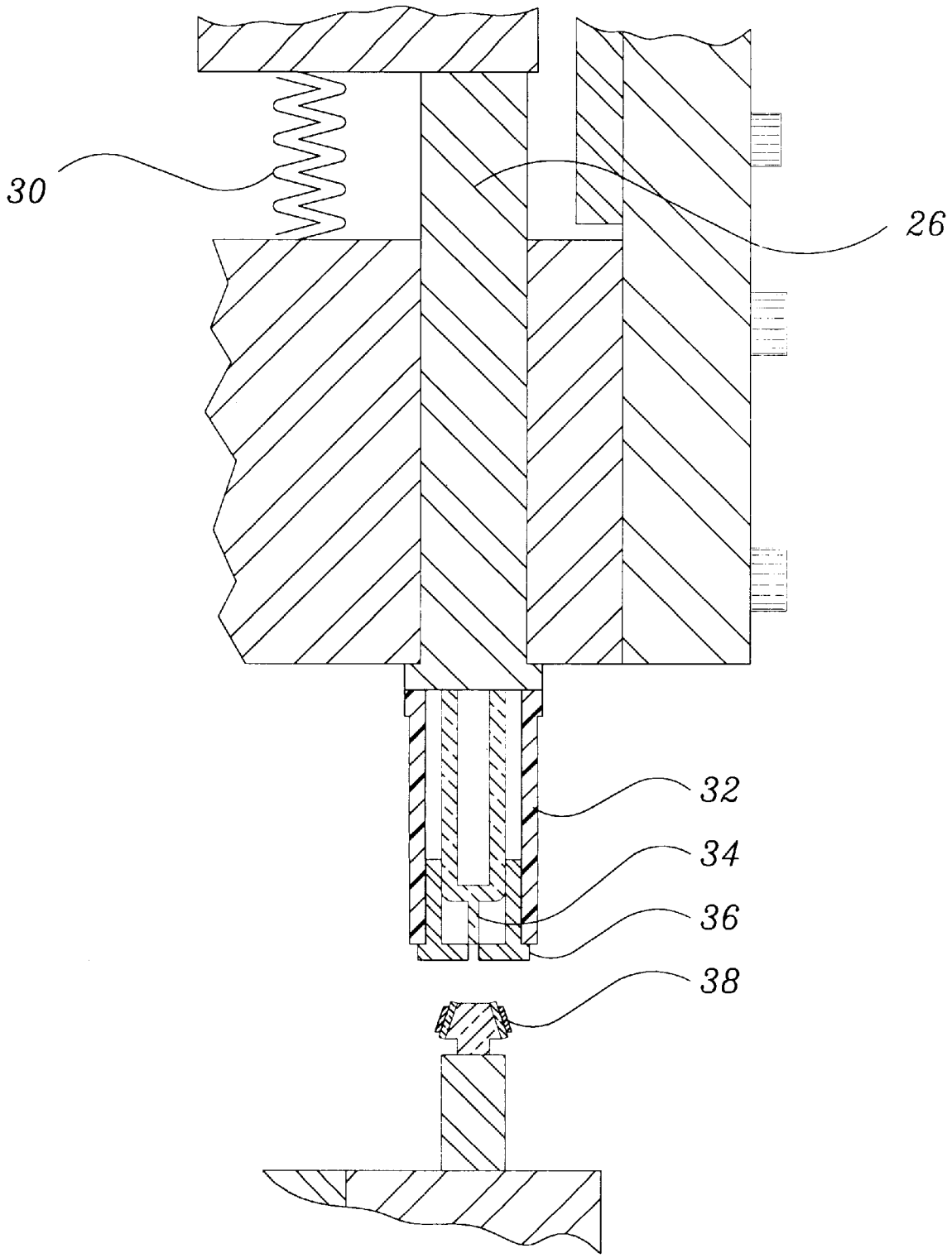
FIG. 3 is an exploded cross sectional view of the assembled ram, return spring, punch, die, and portion of the frame near said components.

Referring now to the drawings, there is shown in FIGS. 1–3 a preferred embodiment of the improved clinching, crimping and punching press 10 of this invention. Subject to the types of punches and dies used, the improved clinching, crimping and punching press is particularly adapted for use in clinching, crimping, punching, stenciling, riveting, stamping and holding operations of sheet metal. A unique feature of the present invention is its utilization of the substantial force provided by an air stroke actuator 12 in the form of an air spring along with the special camming system to provide the required force for the aforementioned operations. All component attachments, when necessary, are achieved with conventional fasteners such as screws, bolts, threads, pins, welds, adhesives or rivets as desired by the manufacturer of the art described.

The drawings show the improved clinching, crimping and punching press 10 comprising a frame 16 having a first opening 40, a cutout 42 and a bored hole 44 between said first opening 40 and said cutout 42. Onto said frame 16 and into said first opening 40 of said frame 16 is mounted a first end of an air stroke actuator 12, typically an air spring from companies such as Goodyear® or Firestone®. An air spring is a commercial component which typically comprises a rubber bag having an air inlet and mounting plates on each end for attachment. When pressurized, each end displaces relative to the other. Since force is proportional to air pressure multiplied by cross sectional area, the air spring provides significantly more force than a typical air cylinder arrangement due to the substantial cross sectional area of the rubber bag. A further advantage of the air spring is its ability to flex within its plane of movement thereby allowing for misalignments of connected components which mate with other components. In alternative embodiments where lesser punching, crimping or clinching forces are required, the air stroke actuator 12 may take the form of an air piston and cylinder. Generally said air stroke actuator 12 is mounted perpendicular to said bored hole 44.

Onto a second end of said air stroke actuator 12 is mounted a rolling cam housing 31 which houses an extending rolling cam 29. Said rolling cam 29 is positioned within said first opening 40 between a topmost cam roller 18 and a ram cam roller 22. Each of said rollers 29, 18, 22 is able to rotate within its respective housing 31, 20, 24. Said topmost cam roller 18 is mounted within its topmost cam roller housing 20 and said housing 20 is adjustably attached to said frame 16 within said first opening 40, opposite said air stroke actuator 12. Said adjustable attachment is achieved via a topmost cam roller adjustment bolt 21 which is placed onto or through said frame and into said first opening. Said topmost cam roller housing 20 may be further secured by placing screws, bolts or fasteners through said frame and into said topmost cam roller housing 20.

Said ram cam roller 22 is mounted within its ram cam roller housing 24 and said housing 24 is mounted onto a first end of a ram 26 opposite said cutout 42. Said ram 26 is moveably placed into and through said bored hole 44 and a second end of said ram 26 is capable of extending into said cutout 42. In a preferred embodiment, a bearing plate 14 is mounted opposite said air stroke actuator such that it is able to form a bearing surface with said rolling cam 29. Alternate embodiments which are not used in continuous or heavy operations may forego use of the bearing plate 14. In a preferred embodiment, a stop bolt 28 is placed onto or through said frame 16 and into said first opening 40 opposite said rolling cam 29 in order to limit the travel of said rolling cam 29. Alternative embodiments may forego use of said stop bolt 28 if the travel of said rolling cam 29 does not need the adjustment feature or if the user desires not to have the adjustment feature. In a preferred embodiment, a return spring 30 is mounted within said first opening 40 opposite said topmost cam roller housing 20 and between said ram cam roller housing 24 and said frame 16. The return spring 30 provides for ram 26 return when the air pressure is released from the air stroke actuator 12.

In a preferred embodiment, within said cutout 42 and onto said ram is placed the desired ram punch 34 and opposite said punch is placed the desired die 38. Should the operation require, the die 38 and punch 34 may be opposingly switched in their placement. Should the user desire to perform a clinching operation, a stripper 32 and a ram bushing 36 would be provided around said punch 34. The present art utilizes punches 34 and dies 38 which are provided by third parties and does not claim the art of said punches 34 and dies 38. Nevertheless, those skilled in the art will recognize that various modifications to the cutout 42 may be required in order to use the desired punch and die combination. This may require drilling, threading and other machining operations to the ram 26 or that portion of the frame 16 which comprises the cutout 42.

In operation, the user installs the desired punch 34 and die 38 combination within the cutout 42 and places a piece or pieces of sheet metal between said punch 34 and die 38. Upon application of compressed air to the air stroke actuator 12, the rolling cam 29 of said air stroke actuator 12 is driven forward between said topmost cam roller 18 and said ram cam roller 22 and impinges upon said stop bolt 28 if installed. Since the topmost cam roller 18 is secured to said frame 16 through said topmost roller cam housing 20, the force placed upon said ram cam roller 22 by the rolling cam 29 driving between said rollers 18, 22 causes the ram 26 to be extended and forced downward further into said bored hole 44. The downward movement of the ram 26 causes the aforementioned punch 34 to contact and compress the piece or pieces of sheet metal between said punch 34 and die 38. The extension of the ram 26 and thus the punch 34 into the die 38 is limited by the control and adjustment of the topmost cam roller adjustment bolt 21. The return spring 30 returns the ram 26 to its rest position when the air pressure to the air stroke actuator 12 is released.

The stop bolt 28 is required in some applications in order to ensure that the rolling cam 29 center does not travel beyond the axis defined by a line drawn between the center of the topmost cam roller 18 and said ram cam roller 22. In some applications, should the rolling cam 29 travel beyond this axis, the air stroke actuator 12 will not have sufficient return force to retract the rolling cam 29 into its rest position. This would result in the ram 26 maintaining an extended position and may prohibit removal of any sheet metal material from the junction of the die 38 and punch 34.

As described, the present art is shown with a clinching die 38 and its associated punch 34, stripper 32, and ram bushing 36 in place. The clinching process bonds two pieces of sheet metal together by forcing a portion of the sheet metal defined by the diameter of the punch 34 into a die 38 having an inverted taper. The die 38 expands outwardly when the punch 34 retracts, thereby allowing for removal of the sheet metal. The art of the present invention is drawn to the press 10 alone and the combination of the press 10 with the clinching, crimping, punching, stenciling or holding punches and dies of the user's choice but no claim is made to the punches and dies apart from the press.

From the foregoing description, those skilled in the art will appreciate that all objects of the present invention are realized. An improved press for clinching, crimping, punching, stenciling, riveting, stamping and holding operations is shown which is particularly adapted for operation with sheet metal. The press of this invention is able to provide the required force for such operations without the use of hydraulics or exceptionally large and heavy equipment.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A press comprising:

a frame having a first opening, a cutout and a bored hole between said first opening and said cutout; and an air stroke actuator having a first end and a second end, said first end attached to said frame within said first opening and said second end attached to a rolling cam housing, said rolling cam housing having a rolling cam extending from said rolling cam housing opposite said second end of said air stroke actuator; and a ram having a first end and a second end and moveably placed within said bored hole such that said first end extends into said first opening; and a topmost roller housing adjustably mounted within said first opening opposite said air stroke actuator and said ram, said topmost roller housing having a topmost cam roller extending therefrom towards said ram; and a ram cam roller housing attached to said first end of said ram, said ram cam roller housing having a ram cam roller extending therefrom towards said topmost cam roller, said air stroke actuator positioned such that said rolling cam is capable of driving between said topmost cam roller and said ram cam roller when said air stroke actuator is pressurized thereby forcing said second end of said ram to move within said cutout.

2. The press as set forth in claim 1 whereby:

said air stroke actuator comprises an air spring.

3. The press as set forth in claim 2 further comprising:

a return spring positioned between said ram cam roller housing and said frame.

4. The press as set forth in claim 2 further comprising:

a stop bolt positioned onto said frame and into said first opening opposite said rolling cam whereby the travel of said rolling cam is limited.

5. The press as set forth in claim 2 further comprising:

a bearing plate mounted within said first opening whereby said ram cam roller may bear upon a bearing surface.

6. The press as set forth in claim 2 further comprising:

a topmost cam roller adjustment bolt placed onto said frame and into said first opening and further contacting said topmost roller cam housing whereby said bolt may control the position of said topmost cam roller relative to said bored hole.

7. The press as set forth in claim 2 further comprising:

a punch attached to said second end of said ram and a die mounted within said cutout whereby said punch is able to compress one or more pieces of sheet metal between said punch and die when said air stroke actuator is pressurized.

8. The press as set forth in claim 7 whereby:

said die and punch are shaped for clinching two or more pieces of sheet metal.

9. A press comprising:

a frame having a first opening, a cutout and a bored hole between said first opening and said cutout; and an air stroke actuator having a first end and a second end, said first end attached to said frame within said first opening and said second end attached to a rolling cam housing, said rolling cam housing having a substantially extended rolling cam, and a ram having a first end and a second end and moveably placed within said bored hole such that said first end extends into said first opening; and a topmost roller housing adjustably attached within said first opening opposite said ram, said topmost roller housing having a topmost cam roller substantially extended therefrom; and a ram cam roller housing positioned onto to said first end of said ram, said ram cam roller housing having a ram cam roller substantially extended therefrom, said first end of said air stroke actuator and said ram cam roller and said topmost roller positioned such that said rolling cam is capable of driving between and engaging said topmost cam roller and said ram cam roller when said air stroke actuator is actuated thereby forcing said second end of said ram to move within said cutout.

10. The press as set forth in claim 9 whereby:

said air stroke actuator comprises an air spring mounted substantially perpendicular to said bored hole.

11. The press as set forth in claim 10 further comprising:

a return spring positioned between said ram cam roller housing and said frame.

12. The press as set forth in claim 10 further comprising:

a stop bolt positioned onto said frame and into said first opening opposite said rolling cam whereby the said rolling cam impinges upon said stop bolt when said air stroke actuator is pressurized.

13. The press as set forth in claim 10 further comprising:

a bearing plate of tool steel mounted within said first opening whereby said ram cam roller may bear upon a bearing surface.

14. The press as set forth in claim 10 further comprising:

a topmost cam roller adjustment bolt placed onto said frame and into said first opening and further contacting said topmost roller cam housing whereby said bolt may control the position of said topmost cam roller relative to said bored hole; and one or more fasteners attached to said frame and said topmost roller cam housing whereby further securing of said topmost roller cam housing is provided.

15. The press as set forth in claim 10 further comprising:

a punch attached to said second end of said ram and a die attached to said frame within said cutout whereby said punch is able to compress one or more pieces of sheet metal between said punch and die when said air stroke actuator is pressurized.

16. The press as set forth in claim 15 whereby:

said die and punch are shaped for providing one or more of the following operations; clinching crimping, punching, stenciling, riveting, stamping or holding of sheet metal.

17. The press as set forth in claim 10 further comprising:

a die attached to said second end of said ram and a punch attached to said frame within said cutout whereby said die is able to compress one or more pieces of sheet metal between said punch and die when said air stroke actuator is pressurized.

18. The press as set forth in claim 17 whereby:

said die and punch are shaped for providing one or more of the following operations; clinching crimping, punching, stenciling, riveting, stamping or holding of sheet metal.

* * * * *